United States Patent [19]

Chiang et al.

[11] Patent Number: 4,630,747

[45] Date of Patent: Dec. 23, 1986

[54] GRAVITATIONALLY-OPERATING COLLAPSIBLE BASKET

[76] Inventors: Ming-Yao Chiang; Pei-Leh Chiang, both of P.O. Box 10160, Taipei, Taiwan

[21] Appl. No.: 857,482

[22] Filed: Apr. 30, 1986

[51] Int. Cl.[4] ..... B65D 6/18

[52] U.S. Cl. ..... 220/7; 220/6; 217/15; 217/47

[58] Field of Search ..... 220/7, 6, 4 F, 1.5; 217/15, 47

[56] References Cited

U.S. PATENT DOCUMENTS

| | | | |
|---|---|---|---|
| 2,573,089 | 10/1951 | Armenia | 220/7 X |
| 2,868,407 | 1/1959 | Woodcock | 220/7 |
| 4,044,910 | 8/1977 | Box | 220/6 X |
| 4,062,467 | 12/1977 | Friedrich | 220/7 |
| 4,320,845 | 3/1982 | Waller | 220/7 X |
| 4,491,231 | 1/1985 | Heggeland et al. | 220/6 |
| 4,591,065 | 5/1986 | Foy | 220/6 X |

FOREIGN PATENT DOCUMENTS 0073357 9/1983 European Pat. Off. .

*Primary Examiner*—Steven M. Pollard

[57] ABSTRACT

A collapsible basket includes an upper frame, two side plates pivotedly mounted on the right and left sides of the frame, a front plate and a rear plate pivotedly mounted on the front and rear sides of the frame, and a bottom plate slidingly engaged with both side plates, in which the two side plates can be angularly moved to be pendant by their gravitational force, and the bottom plate will then gravitionally descend along the two side plates to its lowest position, and the rear and front plates are finally angularly moved by the gravitational force to engage with the bottom plate to form a cubic or parallelepiped basket ready for filling use; and reversely, all the plates can be gravitationally collapsed by inverting the assembled basket to become a folded compact unit convenient for handling and storage.

2 Claims, 9 Drawing Figures

GRAVITATIONALLY-OPERATING COLLAPSIBLE BASKET

BACKGROUND OF THE INVENTION

Martelli disclosed an "Assemblable and Stackable Crate of Plastic Material and Apparatus for Assembling Same" in his European Patent Application of Application No. 82107044.8 filed on Aug. 4, 1982, in which the crate consists of bottom (F) and of sidewalls (p1, P2) which in a second operative step are secured in their erected position of use to the bottom (F). Between each one of the sidewall (P1, P2) and the bottom (F) there are provided articulated connection means (1, 3, 4, 5, 6, L) which permit to raise the sidewalls (P1, P2), initially coplanar to the crate bottom (F), in order to form the crate by an angular movement through about 90° (The copy of Martelli's application is enclosed herewith for the examination reference). However, Martelli's crate has the following defects:

1. For knocking down the sidewalls from the bottom or erecting the sidewalls on the bottom, all the connecting points must be manually disassembled or assembled to cause inconveniences for the user.
2. All the connecting extensions, with their corresponding sockets, must be carefully fabricated or processed to increase production complexibly for their mutual smooth engagement or disengagement, since the engagement/disengagement is an angular movement other than the normal linear movement.

The present inventor has found the defects of such an European patent application, and invented the present gravitationally-operating collapsible basket.

SUMMARY OF THE INVENTION

The object of the present invention is to provide a collapsible basket including: an upper frame, two side plates pivotedly mounted on the right and left sides of the frame, a front plate and a rear plate pivotedly mounted on the front and rear sides of the frame, and a bottom plate slidingly engaged with both side plates, whereby upon the releasing of the two side plates to be pendant, the bottom plate will gravitationally descend along the grooves longitudinally formed in the side plates to the lowest position, and then the front and rear plates will be angularly rotated to be pendant by their gravitational force so as to form a cubic or parallelepiped basket ready for filling service; and when reversing the assembled basket, all plates will be gravitationally collapsed to become a compact unit, having smaller volume for convenienft storage and handling.

DETAILED DESCRIPTION

Figure 1:
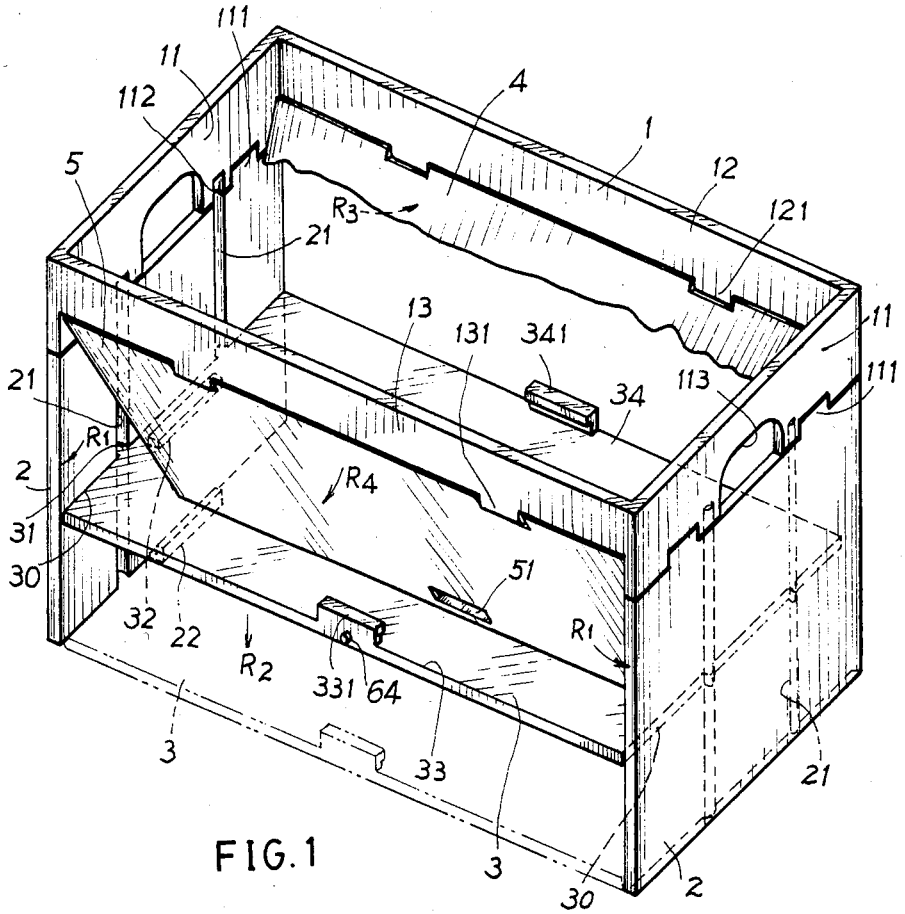
FIG. 1 is a perspective illustration of the present invention.

As shown in the figures, the present invention comprises: an upper frame 1; two side plates 2, 2 respectively pivotedly mounted on both the right and left sides of the upper frame 1; a bottom plate 3; a rear plate 4 and a front plate 5 respectively pivotedly mounted on both the front and rear sides of the frame 1.

Figure 2:
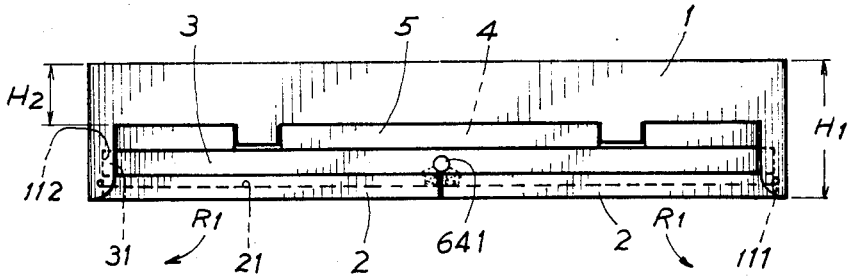
FIG. 2 is a front-view drawing of the present invention as collapsed.

The upper frame 1 includes two side fencing elements 11, 11 positioned at right and left sides of the frame 1, a rear fencing element 12 and a front fencing element 13 to form a square or rectangular frame. Each side plate 2 is pivotedly mounted on each side fencing element 11 by a hinge 111. Each side element 11 is formed with two short grooves 112 to correspond with the two longitudinal grooves 21 formed on each side plate 2. The short grooves 112 are adapted for respectively engaging two extensions 31 formed on each side edge 30 of the bottom plate 3. The length of each short groove 112 is equal to the sum of the thickness of bottom plate 3 and that of each side plate 2 as shown in dotted line of FIG. 2. The height H1 of each side fencing element 11 should be larger than the height H2 of either front or rear fencing element 13 or 12 to allow all plates 2, 3, 4, 5 to be possibly folded and stored within the space as defined by all the fencing elements 11, 12, 13 as shown in FIG. 2.

The rear plate 4 is pivotedly mounted on the rear fencing element 12 by a hinge 121. The front plate 5 is pivotedly mounted on the front fencing element 13 by a hinge 131. Each side plate 2 is formed with an extension key 22 on its inner bottom edge to engage with a groove 32 formed on each bottom side edge of the bottom plate 3, so that when the bottom plate 3 gravitationally descends by slidingly engaging each pair of extensions 31 of bottom plate 3 with every two longitudinal grooves 21 of each side plate 2, until its lowest position, the bottom plate 3 will be stably held by engaging each groove 32 with each extension key 22. On the front edge 33 of the bottom plate 3, there is provided with an extension key 331 to engage with a groove 51 formed on the bottom edge of the front plate 5. On the rear edge 34 of the bottom plate 3, there is provided with another extension key 341 to engage with a groove 41 (not shown) formed on the bottom edge of the rear plate 4.

Figure 6:
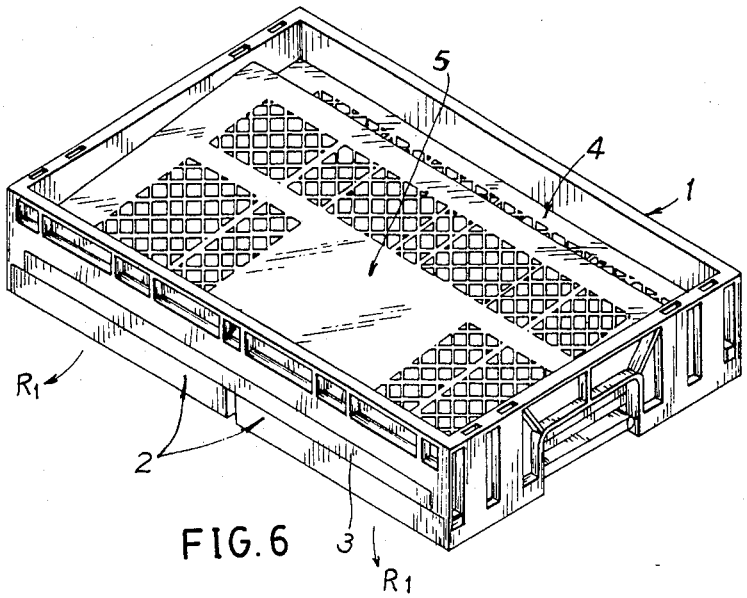
FIG. 6 shows a collapsed basket in accordance with present invention.
Figure 7:
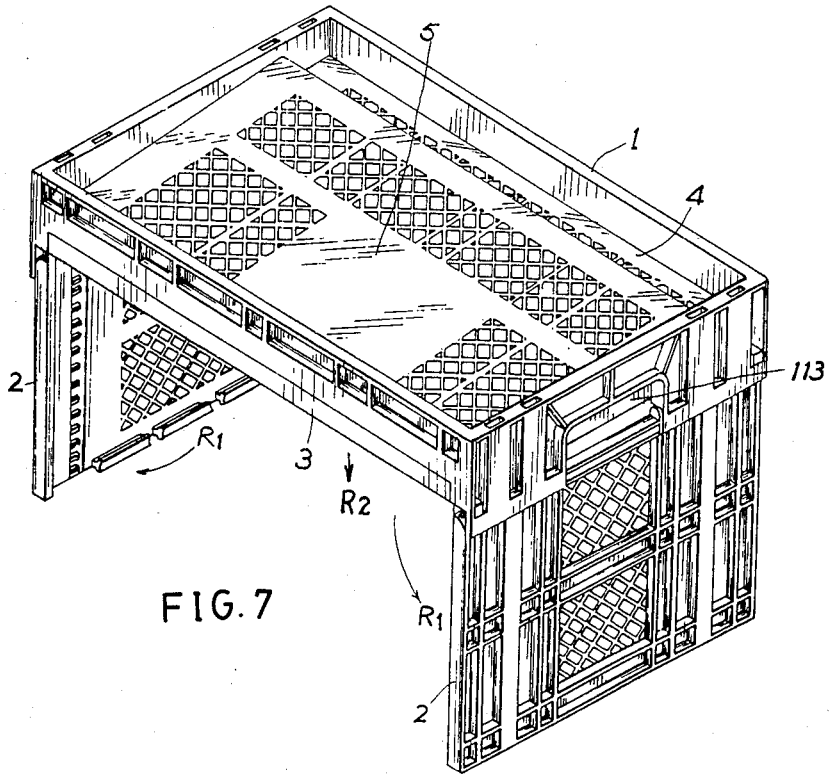
FIG. 7 shows a second step for assembling a basket from FIG. 6 in accordance with the present invention.
Figure 8:
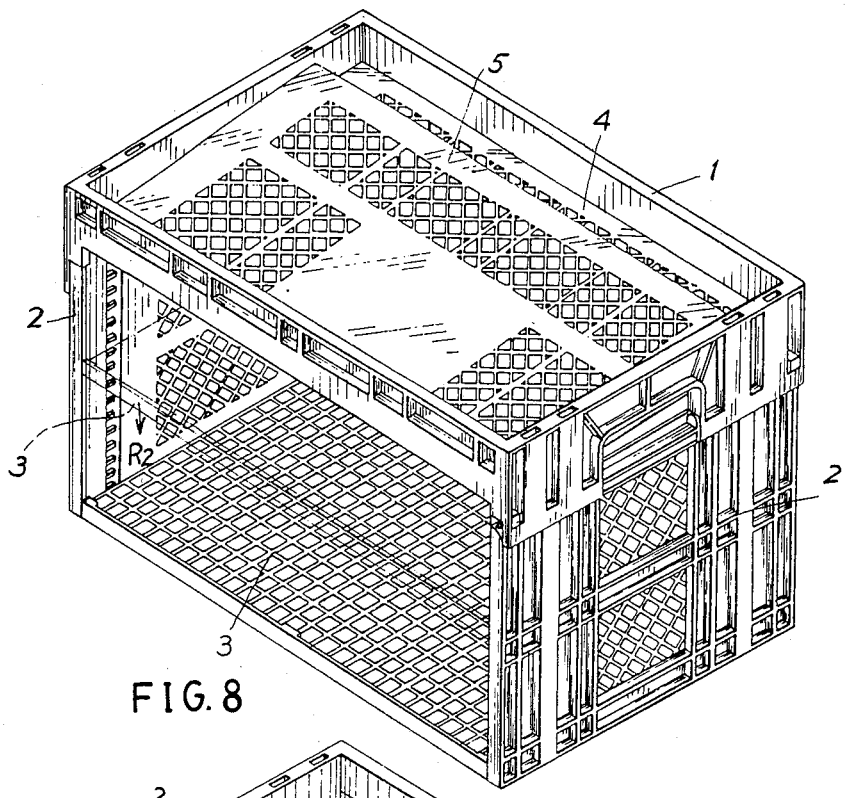
FIG. 8 shows a third step for assembling a basket in accordance with the present invention.
Figure 9:
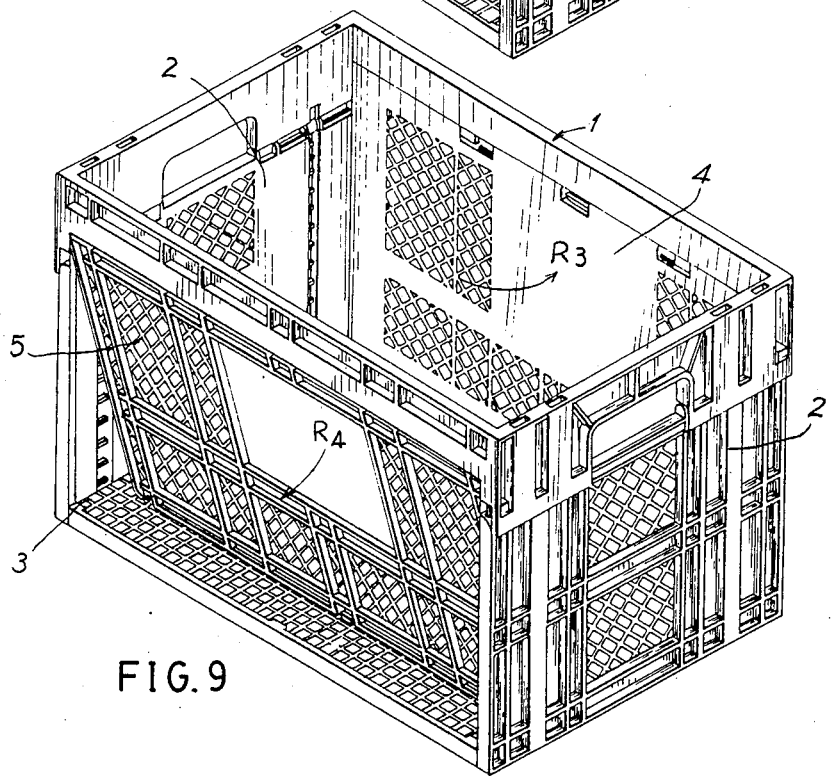
FIG. 9 shows a fourth step for assembling a basket in accordance with the present invention.

The present invention can be made of injection-molded plastic material as shown in FIGS. 6–9 and its assembling procedures are also shown in FIGS. 6–9, in which, the folded basket as shown in FIG. 6 is actuated to release the two side plates 2 each angularly moving around the hinge 111 in a direction R1 as shown in FIG. 7; the bottom plate 3 then automatically descends by its gravitational force along the longitudinal grooves 21 formed on the side plates 2 in direction R2 as shown in FIG. 8; the rear plate 4 and the front plate 5 are then pendant respectively in directions R3, R4 as shown in FIG. 9 to become a parallelepiped or cubic basket ready for the packaging of material or products.

Since this application can be assembled very quickly by merely releasing all plates to form an assembled basket by the gravitational force, and the assembled basket can be reversed to recover all the plates to be a collapsed shape as shown in FIG. 6 in a quicker and more convenient way than the Martelli's European patent application.

Figure 3:
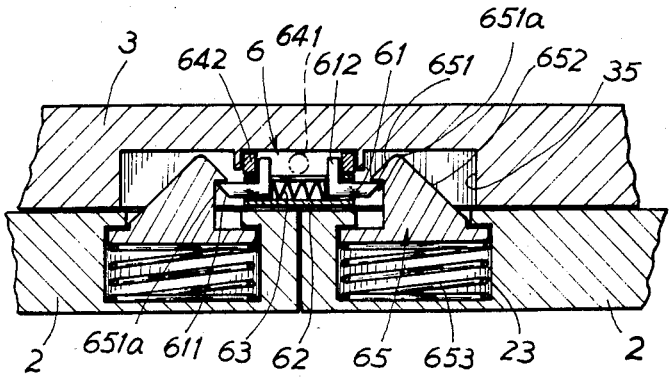
FIG. 3 is a sectional drawing showing the two side plates fastened on the bottom plate in accordance with the present invention.
Figure 4:
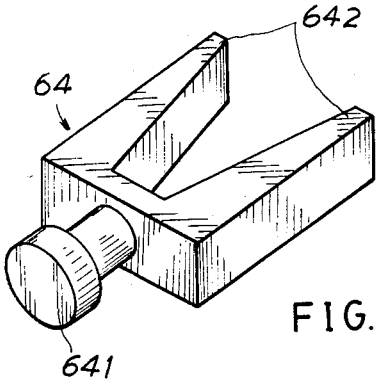
FIG. 4 shows a releasing button of the present invention.

As shown in FIGS. 2–4, the present invention further comprises a fastening means 6 for securing the two side plates 2 to the bottom plate 3 when folding the present invention as shown in FIG. 2.

Figure 5:
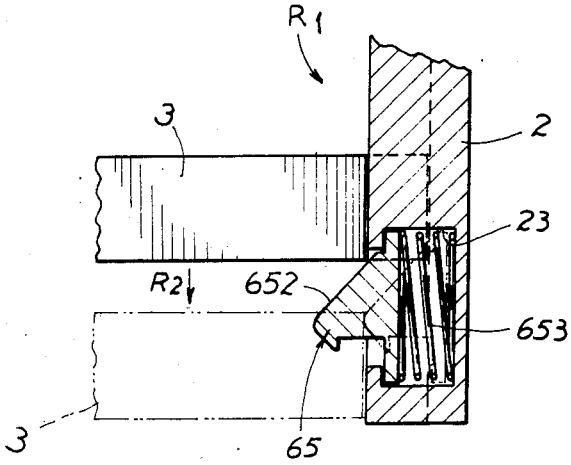
FIG. 5 shows a descending bottom plate retracting a locking head held in the side plate of the present invention.

The fastening means 6 includes: two latches 61 each having a ratchet-toothed end 611 and each resiliently held within a jacket 62 fixed in a socket 35 formed on the front face of plate 3, as restored by a restoring spring 63 retained in the jacket 62 and each having a top extension 612, a releasing button 64 reciprocating in socket 35 and having a front button 641 and two inclined surfaces 642 faced with one another each surface 642 tapered inwards and each surface 642 operatively retracting each top extension 612 and each latch 61, and two locking heads 65 each resiliently held in a socket 23 formed on the lower portion of the side plate 2, each locking head 65, as tensioned by a tensioning spring 653 fixed in the socket 23, having a first inclined surface 651 and a hook portion 651*a* adjacent to the inclined surface 651 and operatively engaging with each ratchet-toothed end 611 of the latch 61 when folding each side plate 2 with the bottom plate 3 as shown in FIG. 2, and having a second inclined surface 652 which is tapered from the common vertex of the first surface 651 towards the surface of the side plate 2, to be adaptably depressed into the socket 23, when the bottom plate 3 gravitationally descending along the two pendant side plates 2 when assembling a basket of the present invention as shown in FIG. 5. By the way, the two side plates 2 can be stably secured to the bottom plate 3 for folding the present invention as shown in FIGS. 3 and 2, when both locking heads 65 in two side plates 2 engage with two latches 61 in bottom plate 3. Reversely, when depressing the button 64 on the bottom plate 3, the two inclined surfaces 642 will retract both latches 61 to disengage both locking heads 65 to thereby angularly move each side plate 2 in direction R1 as shown in FIGS. 6, 7 to start the procedure for assembling a basket.

After folding all the plates of the present invention as shown in FIGS. 6 and 2, they should be arranged in the order as: uppermost rear and front plates 4, 5; middle bottom plate 3 and the lowest two side plates 2, as horizonally stacked. By inverting the assembled basket as shown in FIG. 9, all the plates will be gravitationally collapsed to become a folded compact unit, convenient for handling and storage.

The fastening means 6 ca be dually provided on both front and rear sides of the present invention for balanced assembling or disassembling operation therefor.

When folding the assembled basket, the first clapping on the rear and front plates 4, 5 to disengage the extension keys 331, 341 of bottom plate 3 should be done to initiate the folding operation and then all plates can be gravitationally folded.

We claim:

1. A gravitationally-operating collapsible basket comprising:

an upper frame having two side fencing elements, a rear and a front fencing element to form a rectangular or square frame;

two side plates, each pivotedly mounted on each said fencing element by a hinge and each side plate formed with two longitudinal grooves, corresponding to two short grooves formed on each said side fencing element of said upper frame, and each formed with an extension key on its inner bottom edge;

a bottom plate including two pairs of extensions formed on the two side edges thereof and each pair of extensions respectively engaged with every two longitudinal grooves formed on each side plate, two grooves formed on two side bottom edges each groove operatively engaged with each said extension key of side plate, an extension key formed on the front edge, and another extension key formed on the rear edge;

a rear plate pivotedly mounted on said rear fencing element by a hinge and formed with a groove on its bottom edge to operatively engage with said extension key formed on the rear edge of said bottom plate; and a front plate pivotedly mounted on said front fencing element by a hinge and formed with a groove on its bottom edge to operatively engage with said extension key formed on the front edge of said bottom plate;

said height of each said side fencing element of said upper frame being larger than the height of said rear or front fencing element such that the difference of said two heights is equal to the sum of thickness of all said plates as folded by the order of the uppermost rear and front plates, middle bottom plate and the lowest two side plates, as horizontally stacked;

whereby upon the releasing of said two side plates, said bottom plate will gravitationally descend along said two side plates, and the rear and front plates will then angularly move to be pendant to assemble a cubic or parallelepiped basket; and upon the reversing of the assembled basket, all plates will be gravitationally collapsed to become a folded compact unit.

2. A basket according to claim 1, comprising a fastening means for securing the two side plates to said bottom plate when folding said basket, said fastening means including:

two latches each having a ratchet-toothed end and each resiliently held within a jacket fixed within said bottom plate, as restored by a restoring spring retained in the jacket and each having a top extension;

a releasing button reciprocatively held in said bottom plate and having a front button and two inclined surfaces faced with one another and each inclined surface tapered inwards and each operatively retracting each said top extension of said latch; and two locking heads each resiliently held in the lower portion of each said side plate, having a first inclined surface and a hook portion adjacent to said first inclined surface operatively engaging with each ratchet-toothed end of said latch when folding each said side plate with said bottom plate, and having a second inclined surface, tapered from the common vertex of said first inclined surface towards the surface of each said side plate, to be adaptably depressed into a socket of said side plate when descending said bottom plate along said two side plates.

* * * * *